US006200013B1

(12) United States Patent
Takeuchi et al.

(10) Patent No.: US 6,200,013 B1
(45) Date of Patent: Mar. 13, 2001

(54) PROCESS FOR UNIFORMLY MIXING MATERIALS AND APPARATUS THEREFOR

(75) Inventors: Yukihisa Takeuchi, Nishikamo; Nobuo Takahashi, Owariasahi, both of (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/217,041

(22) Filed: Dec. 21, 1998

(30) Foreign Application Priority Data

Dec. 26, 1997 (JP) ..... 10-352905
Dec. 26, 1997 (JP) ..... 9-361375

(51) Int. Cl.[7] ..... B01F 13/00

(52) U.S. Cl. ..... 366/162.4; 366/162.4; 366/167.1; 366/184; 366/348; 422/257

(58) Field of Search ..... 366/162.4, 150.1, 366/173.1, 167.1, 273, 275, 184, 348; 422/257, 186.02, 186.04; 239/3, 4, 690, 695

(56) References Cited

U.S. PATENT DOCUMENTS 2,751,335 * 6/1956 Carver et al. ..... 366/162.4
3,775,058 * 11/1973 Bush .
4,126,711 * 11/1978 Marlow .
4,289,732 * 9/1981 Bauer et al. ..... 366/162.4
4,341,310 * 7/1982 Sangiovanni et al. .
5,011,293 * 4/1991 Roop et al. ..... 366/162.4
5,074,671 * 12/1991 Roueche et al. ..... 366/162.4
5,403,617 * 4/1995 Haaland .
5,621,443 * 4/1997 Buschulte et al. .
5,658,535 * 8/1997 Thayer, III ..... 422/129
5,915,377 * 6/1999 Coffee ..... 239/695

FOREIGN PATENT DOCUMENTS

WO 94/12285 * 6/1994 (WO) ..... 366/162.4
WO 95/32807 * 12/1995 (WO) ..... 366/162.4

* cited by examiner

*Primary Examiner*—Tony G. Soohoo
(74) *Attorney, Agent, or Firm*—Burr & Brown

(57) ABSTRACT

There are provided a method for uniform mixing of materials, which comprises arranging two or more droplet-discharging means of piezoelectricity-controlled type, discharging fine droplets from respective droplet-discharging means, and colliding them with each other to achieve uniform mixing, and an apparatus therefor. The directions of discharging from these droplet-discharging means are set so that the fine droplets discharged from respective droplet-discharging means are collided with each other at an angle of about 90° or 0 to 20°. The method and apparatus enables mixing and reaction of very small amounts of materials.

10 Claims, 4 Drawing Sheets

PROCESS FOR UNIFORMLY MIXING MATERIALS AND APPARATUS THEREFOR

BACKGROUND OF THE INVENTION AND RELATED ART

The present invention relates to a method for uniform mixing of materials using droplet-discharging means of piezoelectricity-controlled type, as well as to an apparatus therefor.

In recent years, mixing and reaction of very small amounts of materials have been necessary in, for example, semiconductor production, chemical reaction or analysis of very small amounts of materials and researches in biotechnology field represented by quick analysis of small amounts of biocompounds (e.g. analysis of small amounts of secretions from particular cells such as nerve cells and the like).

Also in mixing of materials of very high reaction speed or in chemical reaction wherein it is desired to achieve an accurate polymerization degree, it is necessary to mix the materials batchwise each time in a given very small amount to achieve uniform reaction constantly, because when the materials are mixed and reacted in a large amount, the portion of material mixture (wherein mixing has progressed) is already in a reaction stage before the completion of complete mixing, the portion of materials (wherein material mixing is not made) is not yet in a reaction stage, consequently no uniform reaction product is obtained.

When mixing and reaction such as mentioned above is insufficient, there is taken a measure of, for example, maintaining the reactor at low temperatures in order to reduce the reaction speed.

The present invention has been completed in view of the above-mentioned necessities and is intended to provide a method for uniform mixing of materials, which enables mixing and reaction of very small amounts of materials, and an apparatus used in the method.

SUMMARY OF THE INVENTION

According to the present invention there is provided a method for uniform mixing of materials, which comprises arranging two or more droplet-discharging means of piezoelectricity-controlled type, discharging fine droplets from respective droplet-discharging means, and colliding them with each other to achieve uniform mixing.

In the present invention, it is possible that two droplet-discharging means of piezoelectricity-controlled type are arranged and the fine droplets discharged from respective droplet-discharging means are collided with each other at an angle of about 90°, i.e. about right angles or at a small angle of 0 to 20°.

Also in the present invention, it is preferable that two droplet-discharging means of piezoelectricity-controlled type are arranged, fine droplets are discharged in parallel from respective droplet-discharging means, and the respective fine droplets are electrified with opposite charges and, during parallel flight, are attracted to each other and combined by the static electricity of opposite charges.

Further in the present invention, it is possible that two droplet-discharging means of piezoelectricity-controlled type are arranged, first fine droplets are discharged from the first droplet-discharging means and adhered onto a slope coated with an inactive material, and then second fine droplets are discharged from the second droplet-discharging means and collided with the first fine droplets.

According to the present invention, there is also provided an apparatus for uniform mixing of materials, which comprises two or more droplet-discharging means of piezoelectricity-controlled type and a means for colliding the fine droplets discharged from respective droplet-discharging means, with each other.

In this mixing apparatus, it is possible that two droplet-discharging means of piezoelectricity-controlled type are arranged and the directions of discharging from respective droplet-discharging means are set so that the fine droplets discharged from respective droplet-discharging means are collided with each other at an angle of about 90° or at an angle of 0 to 20°.

Also in the mixing apparatus, it is preferred that two droplet-discharging means of piezoelectricity-controlled type are arranged, the fine droplets discharged from respective droplet-discharging means are beforehand electrified with opposite charges, and the directions of discharging from respective droplet-discharging means are set so that fine droplets are discharged in parallel from respective droplet-discharging means. Also in the mixing apparatus, it is preferred that two (first and second) droplet-discharging means of piezoelectricity-controlled type are arranged and a slope coated with an inactive material is provided, and the direction of discharging from the first droplet-discharging means is set so that the fine droplets discharged from the first means can adhere to a given position on the slope and the direction of discharging from the second droplet-discharging means is set so that the fine droplets discharged from the second means can adhere to the position of the slope where the fine droplets discharged from the first means have adhered.

DESCRIPTION OF PREFERRED EMBODIMENTS

In the present method and apparatus for uniform mixing of materials, two or more droplet-discharging means of piezoelectricity-controlled type are arranged and the fine droplets discharged from respective droplet-discharging means are collided with each other to achieve uniform mixing thereof. By such uniform mixing, the two materials are reacted uniformly and a uniform reaction product is obtained.

The droplet-discharging means of piezoelectricity-controlled type used in the present invention is specifically a droplet-discharging device comprising a nozzle section provided with a plurality of holes for discharging a liquid, a pump section provided with one or more chambers for pressurization of liquid communicating with said holes, and one or more piezoelectric/electrostrictive elements, the pump section being bonded to the nozzle section and the piezoelectric/electrostrictive elements being bonded to the walls of said chambers for pressurization of liquid, wherein part of each wall of the chambers for pressurization of liquid is deformed by the functioning of each piezoelectric/electrostrictive element and thereby the liquid fed into each chamber is injected out of each chamber through each hole. Desirably, the nozzle section and the pump section are made of a zirconia ceramic.

Figure 5:
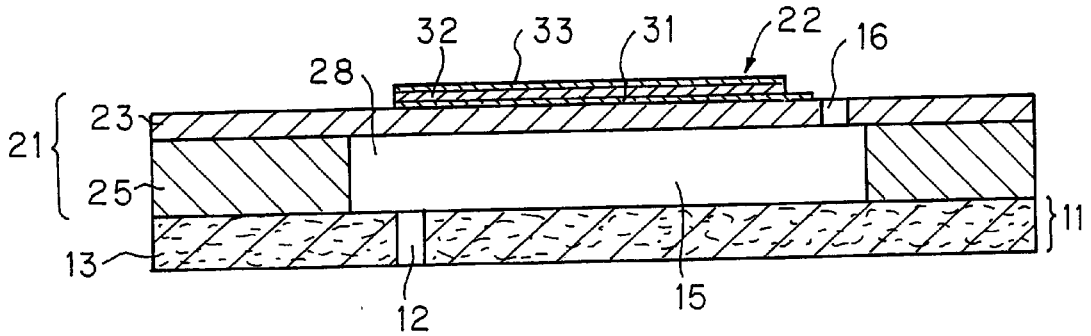
FIG. 5 is a sectional view showing an example of the droplet-discharging device of piezoelectricity-controlled type.

An example of the droplet-discharging device is shown in FIG. 5.

In FIG. 5, a nozzle section 11 is a thin flat nozzle plate 13 having a plurality of holes 12, made of a green sheet of a zirconia ceramic; a pump section 21 comprises a spacer plate 25 having a plurality of windows 28 and a cover plate 23 covering the spacer plate 25 and the windows 28, the spacer plate 25 and the cover plate 23 being each made of a green sheet of a zirconia ceramic; the nozzle section 11 and the pump section 21 are laminated and fired in one piece. Incidentally, the cover plate 23 is provided with liquid inlets 16.

On the outer surface of the cover plate 23 are formed piezoelectric/electrostrictive elements 22 each comprising a lower electrode 31, a piezoelectric/electrostrictive layer 32 and an upper electrode 33.

In the above droplet-discharging device, when an electric field appears between the upper electrode 33 and the lower electrode 31, the piezoelectric/electrostrictive layer 32 is deformed and each cavity (each chamber for pressurization of liquid) 15 formed by the coverage of the windows 28 with the cover plate 23 causes volume reduction, whereby the liquid filled in each cavity 15 is injected through each hole 12 communicating with each cavity 15.

As in the above, in the present invention, the constituent materials of the droplet-discharging device are all a zirconia ceramic; therefore, the device is applicable even when a liquid of a ceramic precursor of acetone type, hydrochloride type or the like is used, and is superior in chemical resistance, heat resistance and toughness.

In the present invention, two or more droplet-discharging devices of piezoelectricity-controlled type such as mentioned above are arranged and the fine droplets discharged from respective droplet-discharging devices are collided with each other to achieve uniform mixing thereof, whereby two materials are reacted uniformly and a uniform reaction product is obtained.

The apparatus for uniform mixing according to the present invention is hereinunder described in detail by way of the Examples shown in the drawings. However, the present invention is in no way restricted to these Examples.

EXAMPLE 1

Figure 1:
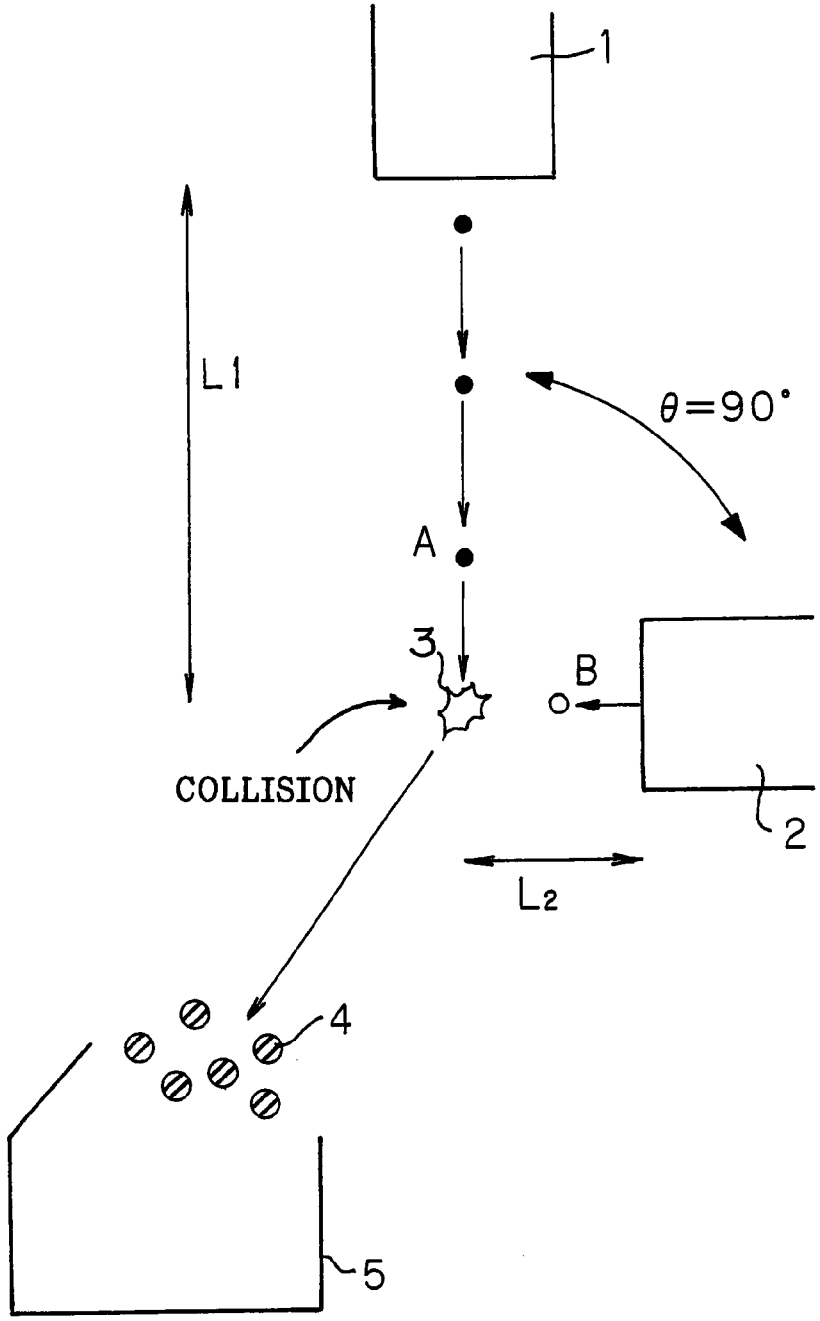
FIG. 1 is a schematic view showing an example of the apparatus for uniform mixing of materials according to the present invention.

FIG. 1 is a schematic view showing an example of the apparatus for uniform mixing of materials according to the present invention.

In FIG. 1, two droplet-discharging devices of piezoelectricity-controlled type are arranged, and the directions of discharging from the discharging device 1 and the discharging device 2 are set so that the fine droplets discharged from respective devices are collided with each other at an angle of 90°.

Materials A and B, which react with each other when mixed, are discharged in the form of fine droplets from the discharging devices 1 and 2, respectively and collided in the air. The uniform mixture 4 obtained from collision at a collision point 3 flies to a direction determined by the inertial forces of materials A and B and is recovered in a recovery container 5 for mixture.

With respect to the distances L1 and L2 from the discharging devices 1 and 2 to the collision point 3, the distance L1 (the distance of vertical dropping) is made sufficiently long so that a constant speed is obtained as a result of balancing between gravity and air resistance; meanwhile, regarding the distance L2 (distance of horizontal discharging), the time of droplet arrival at collision point 3 is stabilized by making small the fluctuation in time of arrival, whereby the probability of in-air collision of fine droplets of different materials (such collision is ordinarily difficult) can be enhanced. The horizontal distance L2 is preferred to be specifically 1 to 2 mm.

In the apparatus of FIG. 1, materials A and B both of high reaction speed can be uniformly mixed and reacted with each other in very small amounts in a short time; moreover, since the materials A and B are collided with each other at a collision angle of about 90° at different speed vectors, very fine droplets (a mixture of materials A and B) can be produced.

EXAMPLE 2

Figure 2:
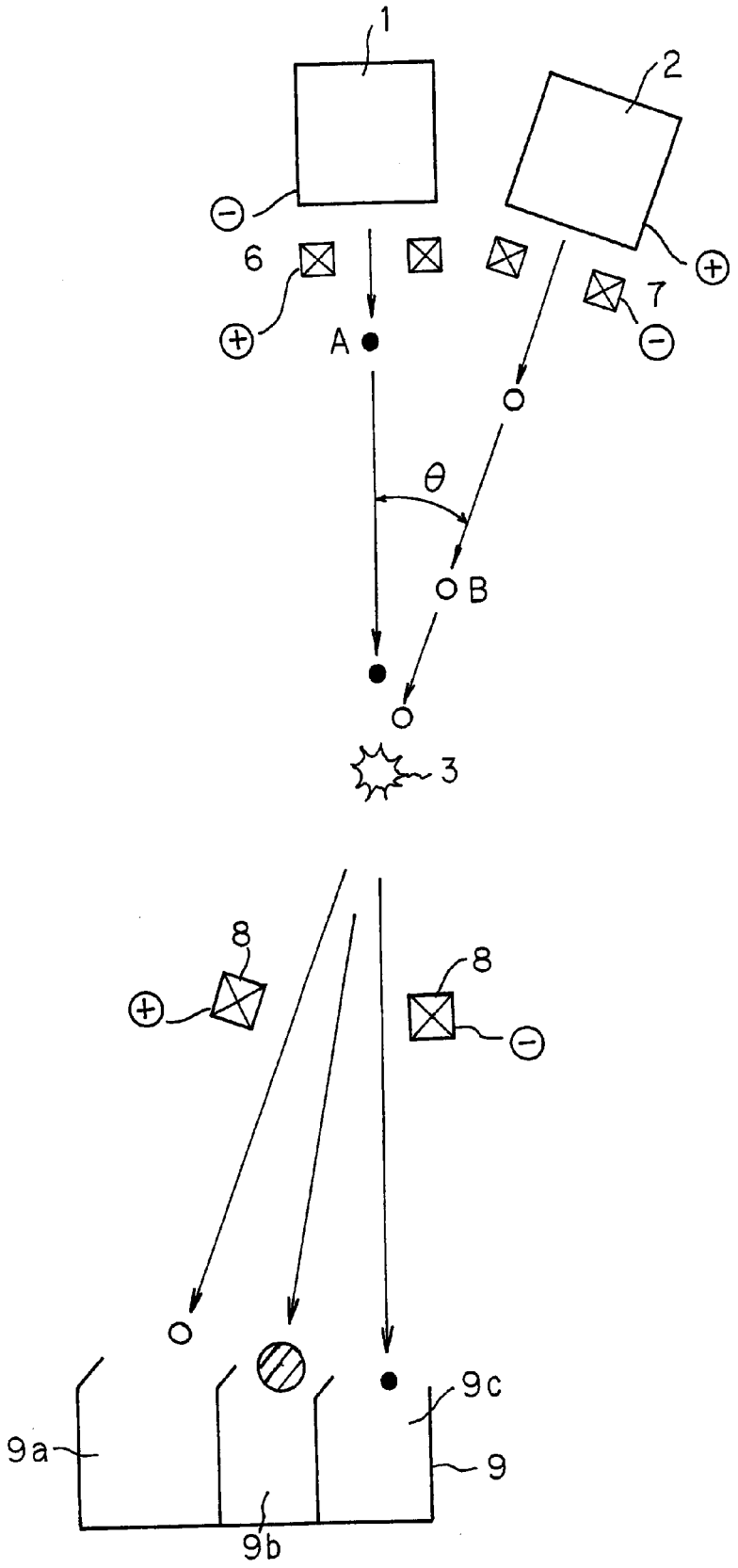
FIG. 2 is a schematic view showing other example of the apparatus for uniform mixing of materials according to the present invention.

FIG. 2 is a schematic view showing other example of the apparatus for uniform mixing of materials according to the present invention.

In FIG. 2, two droplet-discharging devices of piezoelectricity-controlled type are arranged, and the directions of discharging from the discharging device 1 and the discharging device 2 are set so that the fine droplets discharged from respective devices are collided with each other at an angle of 0 to 20°. In this Example, deflection electrodes 6 and 7 are provided in the vicinities of the respective nozzles of the discharging device 1 and the discharging device 2.

Droplets of a material A and droplets of a material B (the two materials react with each other when mixed) can be discharged respectively from the discharging device 1 and the discharging device 2 in oppositely charged states (the material A droplets are charged positively and the material B droplets are charged negatively), and their flight directions can be easily controlled by the deflection electrodes 6 and 7 provided in the vicinities of the nozzles of the two discharging devices.

By colliding the fine droplets discharged from the device 1 and the device 2, with each other at an angle of 0 to 20°, the mixture obtained by collision can be completely separated from the collision-failed droplets A and B. That is, since the mixture (particles formed by collision) makes stable flight in the form of particles and falls on a point different from points on which the collision-failed droplets A and B fall, the mixture can be separated and recovered in the 9*b* of three recovery containers 9*a,* 9*b* and 9*c*.

Further, by providing deflection electrodes 8 downstream of the collision point 3, the collision-failed droplets (particles) A and B can be attracted by the electrodes 8, making easier the separation of the mixture (collided particles) from the collision-failed particles.

EXAMPLE 3

Figure 3:
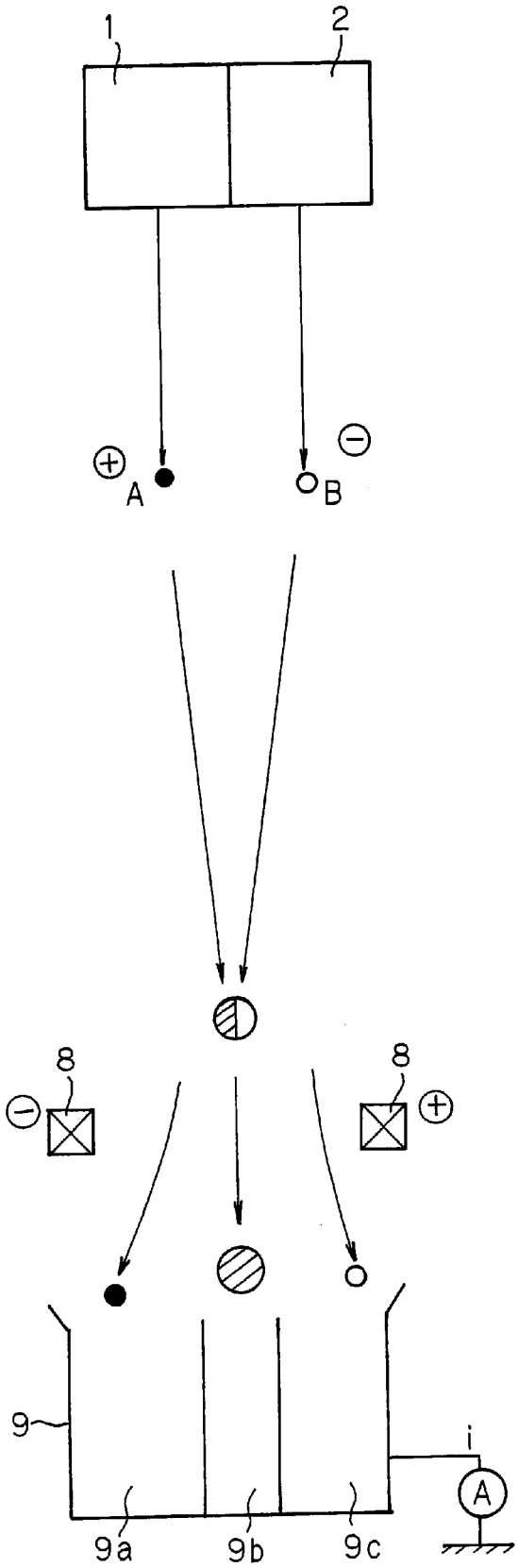
FIG. 3 is a schematic view showing still other example of the apparatus for uniform mixing of materials according to the present invention.

FIG. 3 is a schematic view showing still other example of the apparatus for uniform mixing of materials according to the present invention.

In FIG. 3, two droplet-discharging devices of piezoelectricity-controlled type are arranged, and fine droplets A and B are discharged from respective discharging devices 1 and 2 in parallel (angle of collision=0°) and are charged oppositely.

In the apparatus of FIG. 3, the fine droplets A and B are, during the flight, attracted to each other and combined by the static electricity of opposite charges. Therefore, the probability of collision of fine droplets A and B can be made high even when control of their flight directions is relatively difficult.

Further as shown in FIG. 3, by monitoring the current level or current difference between earth and containers 9*a*, 9*c* of collision-failed droplets (particles) A, B, it is possible to electrically know the probability of collision (in other word, the probability of failed collision). That is, as collision-failed particles A and B (which are charged) are recovered in a larger amount, the earth current i is larger; therefore, by feeding back this current i, the directions of discharging can be corrected easily.

Furthermore in this Example, deflection electrodes 8 are provided downstream of the collision point 3 similarly to the case of FIG. 2, whereby separation of mixture (collided particles) from collision-failed particles is conducted easily.

EXAMPLE 4

Figure 4:
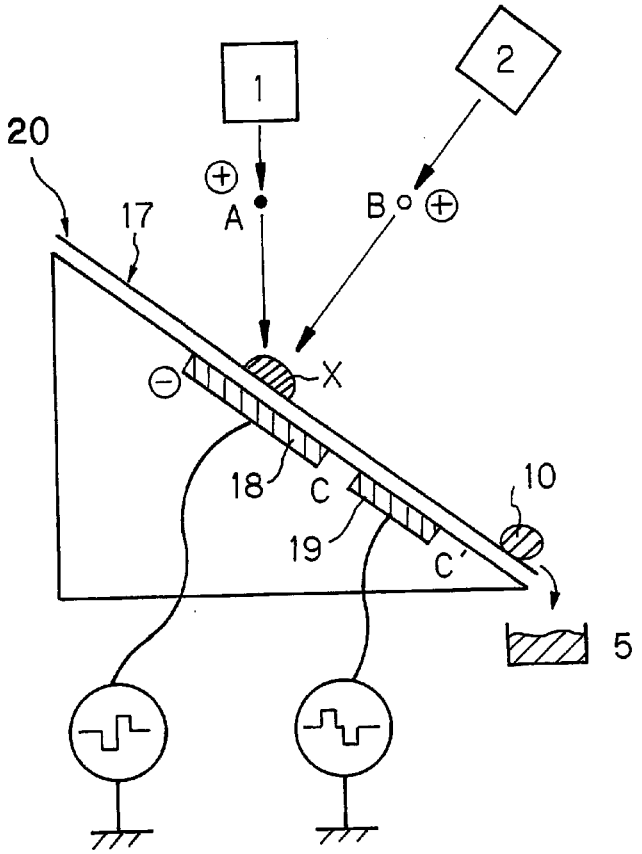
FIG. 4 is a schematic view showing still other example of the apparatus for uniform mixing of materials according to the present invention.

FIG. 4 is a schematic view showing still other example of the apparatus for uniform mixing of materials according to the present invention.

In FIG. 4, two droplet-discharging devices of piezoelectricity-controlled type are arranged, and the direction of discharging from the discharging device 1 and the discharging device 2 are set so that the devices 1 and 2 can discharge fine droplets onto a given position X of a slope 17 coated with an inactive material 20 such as polytetrafluoroethylene [Teflon (trade name)] or the like.

In the apparatus of FIG. 4, fine droplets A are discharged from the discharging device 1 onto the given position X of the slope 17 and adhered thereto; fine droplets B are discharged from the discharging device 2 onto the given position X of the slope 17; thereby, these two kinds of droplets are collided with each other. In this case, since the fine droplets A are at rest, collision is very easy to achieve.

In this Example, the fine droplets A and B are discharged alternately as necessary and mixed; when the weight of resulting mixture reaches a certain level, the mixture 10 is allowed to fall by gravity and recovered into a recovery container 5 provided downstream; thereby, the mixing and reaction amount at collision point X can constantly be controlled at a given level or lower.

As shown in FIG. 4, it is possible that a first control electrode 18 is provided at the backside of the collision point X of the slope 17, the fine droplets A and B are discharged in a charged state (charged in same polarity, positively charged in this case), the inclination angle of the slope 17 is set at an appropriate level, thereby the mixture 10 is allowed to fall and recovered when it reaches an intended amount.

That is, by electrifying the fine droplets A and B positively and electrifying the first control electrode 18 negatively, it is possible to allow large mixture particles to stay on the slope against gravity. When the amount of the mixture has reached a predetermined amount, the first control electrode 18 is nonelectrified or charged positively, whereby the mixture 10 can be allowed to fall and recovered.

In that case, a second control electrode 19 may be provided on the backside of a downstream site of the slope 17 to make sure the falling of the mixture.

The present invention has been described above by way of Examples. In any of the above Examples, it is preferred to control the atmosphere of the space existing from discharging of fine droplets to recovery of mixture (ordinarily, reaction product).

Control of the atmosphere can specifically be conducted as follows.

(1) In order to prevent the bend of droplets during flight, caused by air current and the reduction in collision percentage, caused by the bend, there is used an atmosphere in which convection or the like is suppressed or, as necessary, an atmosphere of controlled current.

(2) In order to control the purity and reactivity of mixture, i.e. reaction product, there is used an inert gas (e.g. nitrogen) or a dust-free atmosphere obtained by filtration through a HEPA filter or the like.

(3) In order to control the reaction speed, the temperature of atmosphere is kept low. In that case, the droplet-discharging devices may be heated as necessary.

In the present invention, in order to electrify the droplets, electrodes may be provided, for example, outside of each nozzle of droplet-discharging device, for electrification of droplets during the flight; or, a metal member may be provided in the flow path near each nozzle of droplet-discharging device and a voltage may be applied to the metal member.

In the present invention, it is necessary to discharge droplets stably. If the liquid in flow path causes fluctuation in, for example, viscosity or specific gravity, unstable discharging is invited and desired mixing of materials becomes impossible. Hence, such fluctuation must be detected immediately and the mixing operation must be stopped depending upon the situation.

For detection of the above fluctuation, it is desirable that the property (e.g. viscosity) of liquid is monitored as disclosed in JP-A-8-201265, by the use of a monitoring means using an electrical constant wherein a voltage is applied to the piezoelectric/electrostrictive layer to induce the vibration of the layer and the change of an electrical constant associated with the vibration is detected.

Specifically, the electrical connection between electric source (for giving rise to droplet discharging) and appropriately selected piezoelectric/electrostrictive layer is cut by a relay at given intervals; simultaneously, a means for measurement of resonance frequency is connected to the piezoelectric/electrostrictive layer by a relay, and an impedance or a resonance frequency at that timing is electrically measured. Thereby, it is monitored whether or not the viscosity of liquid is in a range of stable discharging by discharging device, and it is possible to stop the mixing operation before stable discharging becomes impossible and take a necessary measure for return to normal operation.

By employing the above constitution, the droplet-discharging device per se can be used as a monitoring sensor; therefore, such mechanism is preferred because it is simple, has high reliability for monitoring, and can detect the trouble of discharging device per se at an early timing.

When only the viscosity of liquid is monitored, the number of piezoelectric/electrostrictive layers used for measurement of the above impedance or resonance frequency may be 1 (one); however, when the trouble of discharging device is detected, it is desired that all the piezoelectric/electrostrictive layers are monitored independently.

What is claimed is:

1. A method for uniform mixing of materials, which comprises arranging two or more droplet-discharging means of piezoelectricity-controlled type and at least one recovery container, discharging fine droplets of a first material from a first of said droplet-discharging means, discharging fine droplets of a second material from a second of said droplet-discharging means, said first material being different from said second material, and colliding said fine droplets of a first material and said fine droplets of a second material with each other to achieve uniform mixing thereby forming an admixture or a reaction product which is collected in said at least one recovery container, whereas fine droplets from any of said droplet-discharging means which do not collide with any fine droplets from any other of said droplet-discharging means are not collected in said recovery container.

2. A mixing method according to claim 1, wherein two droplet-discharging means of piezoelectricity-controlled type are arranged and the fine droplets discharged from respective droplet-discharging means are collided with each other at an angle of about 90°.

3. A mixing method according to claim 1, wherein two droplet-discharging means of piezoelectricity-controlled type are arranged and the fine droplets discharged from respective droplet-discharging means are collided with each other at an angle of 0 to 20°.

4. A mixing method according to claim 1, wherein two droplet-discharging means of piezoelectricity-controlled type are arranged, fine droplets are discharged in parallel from respective droplet-discharging means, and the respective fine droplets are electrified with opposite charges and, during parallel flight, are attracted to each other and combined by the static electricity of opposite charges.

5. A mixing method according to claim 1, wherein two droplet-discharging means of piezoelectricity-controlled type are arranged, first fine droplets are discharged from the first droplet-discharging means and adhered onto a slope coated with an inactive material, and then second fine droplets are discharged from the second droplet-discharging means and collided with the first fine droplets.

6. An apparatus for uniform mixing of materials, which comprises two or more droplet-discharging means of piezoelectricity-controlled type and at least one recovery container, a first of said droplet-discharging means communicating with a first material supply source, a second of said droplet-discharging means communicating with a second material supply source, said first droplet-discharging means, said second droplet-discharging means and said at least one recovery container being positioned relative to one another such that fine droplets discharged from said first droplet-discharging means and droplets discharged from said second droplet-discharging means can be collided to form an admixture or a reaction product which is collected in said recovery container whereas fine droplets from any of said droplet-discharging means which do not collide with any fine droplets from any other said droplet-discharging means are not collected in said recovery container.

7. A mixing apparatus according to claim 6, wherein two droplet-discharging means of piezoelectricity-controlled type are arranged and the directions of discharging from respective droplet-discharging means are set so that the fine droplets discharged from respective droplet-discharging means are collided with each other at an angle of about 90°.

8. A mixing apparatus according to claim 6, wherein two droplet-discharging means of piezoelectricity-controlled type are arranged and the directions of discharging from respective droplet-discharging means are set so that the fine droplets discharged from respective droplet-discharging means are collided with each other at an angle of 0 to 20°.

9. A mixing apparatus according to claim 6, wherein two droplet-discharging means of piezoelectricity-controlled type are arranged, the fine droplets discharged from respective droplet-discharging means are beforehand electrified with opposite charges, and the directions of discharging from respective droplet-discharging means are set so that fine droplets are discharged in parallel from respective droplet-discharging means.

10. A mixing apparatus according to claim 6, wherein two droplet-discharging means of piezoelectricity-controlled type are arranged and a slope coated with an inactive material is provided and wherein the direction of discharging from the first droplet-discharging means is set so that the fine droplets discharged from the first means can adhere to a given position on the slope and the direction of discharging from the second droplet-discharging means is set so that the fine droplets discharged from the second means can adhere to the position of the slope where the fine droplets discharged from the first means have adhered.

* * * * *

UNITED STATES PATENT AND TRADEMARK OFFICE

CERTIFICATE OF CORRECTION

PATENT NO. : 6,200,013 B1
DATED : March 13, 2001
INVENTOR(S) : Yukihisa Takeuchi, Nobuo Takahashi It is certified that error appears in the above-identified patent and that said Letters Patent is hereby corrected as shown below:

Title Page, (30) Foreign Application Priority Data
Please replace "Dec. 26, 1997 (JP).....10-352905"
With -- Dec.11, 1998 ( JP).....10-352905--

Signed and Sealed this

Twenty-eighth Day of August, 2001

*Attest:*

Nicholas P. Godici

NICHOLAS P. GODICI
*Acting Director of the United States Patent and Trademark Office*

*Attesting Officer*